United States Patent [19]

Stephan

[11] 4,011,834

[45] Mar. 15, 1977

[54] TOUCHDOWN ELECTROSTATIC DEVELOPMENT APPARATUS

[75] Inventor: Craig H. Stephan, Fairport, N.Y.

[73] Assignee: Xerox Corporation, Stamford, Conn.

[22] Filed: Oct. 2, 1975

[21] Appl. No.: 618,870

[52] U.S. Cl. ..... 118/653; 118/656

[51] Int. Cl.[2] ..... G03G 15/08

[58] Field of Search ..... 118/637; 427/19, 20, 427/21, 22, 23, 24; 355/3 DD; 96/1

[56] References Cited

UNITED STATES PATENTS

| | | | |
|---|---|---|---|
| 2,910,963 | 11/1959 | Herman | 118/637 |
| 3,176,652 | 4/1965 | Mott et al. | 118/637 |
| 3,676,215 | 7/1972 | Gundlach | 96/1 |
| 3,906,896 | 9/1975 | Stansell | 118/637 |
| 3,945,342 | 3/1976 | Drummond | 118/637 |

*Primary Examiner*—Henry S. Jaudon
*Attorney, Agent, or Firm*—James J. Ralabate; Eugene F. Miller; William A. Henry, II

[57] ABSTRACT

An electrostatographic imaging apparatus for dry toner transfer development of latent images, comprising a novel developer donor member bearing raised micro-elements of "boat" shape for self-spacing the donor surface from the image surface during development.

7 Claims, 6 Drawing Figures

Fig. 1.
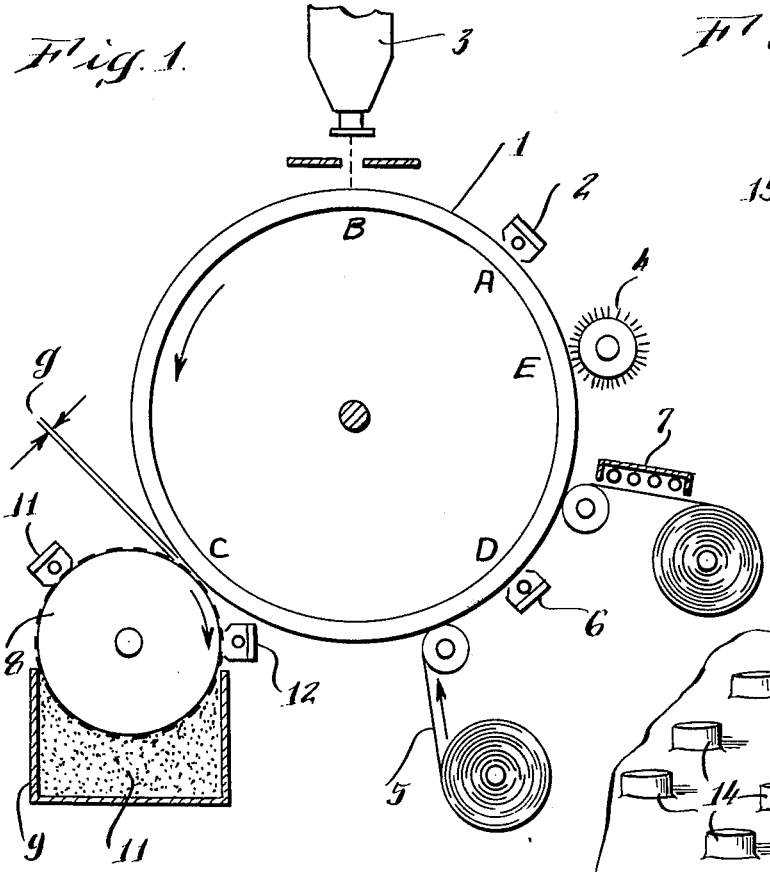
Fig. 2.
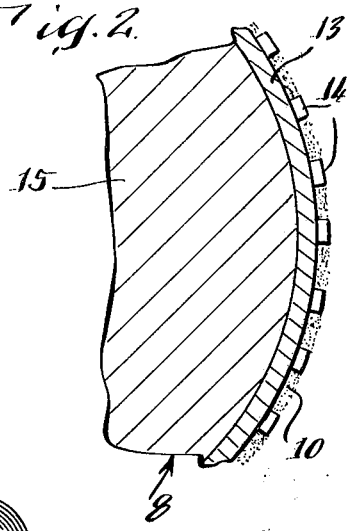
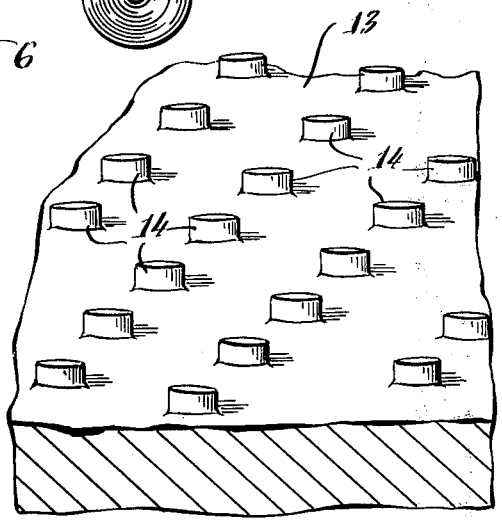
Fig. 3.
Fig. 4.
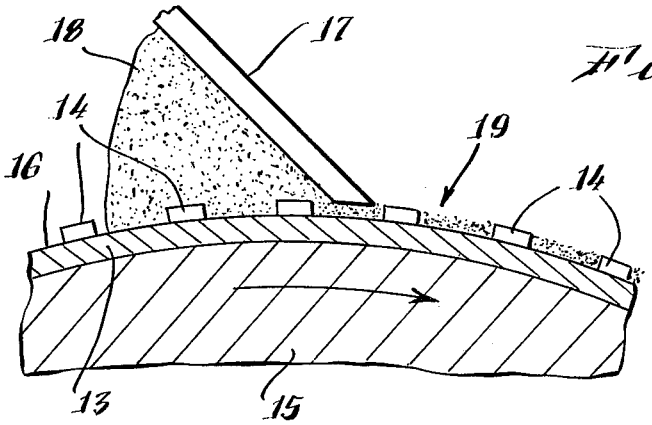
Fig. 5.
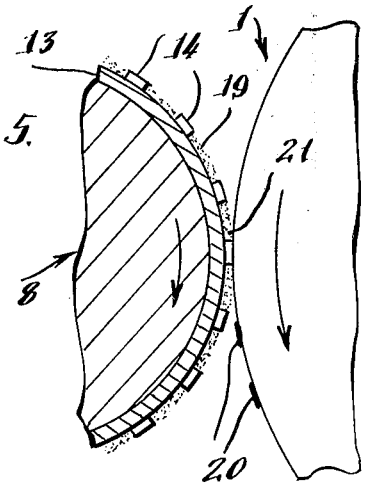

TOUCHDOWN ELECTROSTATIC DEVELOPMENT APPARATUS

BACKGROUND OF THE INVENTION

The present invention is related to xerographic copying systems and, more particularly, to systems which employ what is known as "transfer" or "touchdown" development.

The xerographic process as disclosed in Carlson's U.S. Pat. No. 2,297,691, encompasses a xerographic plate comprising a layer of photoconductive insulating material on a conductive backing. This plate is provided with a uniform electric charge over its surface and is then light exposed to the subject matter to be reproduced. The light exposure discharges the plate areas in accordance with the radiation intensity that reaches it and thereby creates a latent electrostatically charged image on or in the photoconductive layer. Development of the latent image is effected with an electrostatically charged, finely divided material, such as an electroscopic powder, that is brought into surface contact with the photoconductive layer and is held thereon electrostatically in a selective pattern corresponding to the latent electrostatic image. Thereafter, the developed image may be fixed by any suitable means to the surface on which it has been developed or the developed image may be transferred to a secondary support surface to which it may be fixed or utilized by means known in the art.

Once the electrostatic latent image is formed, the method by which it is made visible is the developing process. Various developing systems are well known in the art and include cascade, brush development, magnetic brush, powder cloud, and liquid development. Still another developing method is disclosed in Mayo patent U.S. Pat. No. 2,895,847, in which a developer support member, called a "donor," is employed to present a releasable layer of electroscopic (toner) particles to the photoconductive layer for deposit thereon in conformity with the electrostatic latent image. The Mayo approach is one of several variations which involve the transfer of toner particles from a donor to the photoconductive surface and is therefore called transfer development. This technique is also known as "touchdown development."

The three principal variations of transfer development include (1) an arrangement in which the layer of toner of the donor surface is held out of contact with the electrostatically imaged photoconductor and the toner must traverse an air gap to effect development; (2) an arrangement in which the toner layer on the donor is brought into rolling contact with the imaged photoconductor; and (3) an arrangement in which the toner layer is brought into contact with the imaged photoconductor and skidded across the imaged surface to effect development.

In the first of the above arrangements where the toner and photoconductor surface are maintained out of contact, a layer of toner particles is applied to a donor member which is capable of retaining the particles on its surface and then the donor member is brought into close proximity to the surface of the photoconductor. In this closely spaced position, particles of toner in the toner layer on the donor member are attracted to the photoconductor by the electrostatic charge on the photoconductor so that development can occur. Typically, the spacing between donor and photoconductor is between 1 and 10 mils. This arrangement is referred to as "spaced touchdown development."

In touchdown development, a variety of donor is possible and known in the art. A donor member may be constructed of a variety of materials which includes paper, plastic, cloth, metal, aluminum foil, or metal-backed paper.

In U.S. Pat. No. 3,203,394, to Hope et al, various donors are described which employ the principle of using a set of conductive posts or a conductive screen which is charged in the same polarity and selective amount as the charged toner particles. Accordingly, as the donor member is brought into contact with the toner particles, those areas adjacent to the posts or screen will electrostatically repel the toner, thereby forcing the toner away from those portions. The remaining areas of the donor member are charged to attract the toner particles and the particles accumulated there. As described in the Hope et al patent, a spaced donor member of this type of construction provides better mobility to the toner particles so as to yield sharper xerographic copies.

In U.S. Pat. No. 3,375,806, to Nost, the donor member is described as being either electrically insulative or conductive and may comprise such materials as metal sheets, conductive rubbers, Mylar, or the like.

Although spaced touchdown may be used with a variety of donor as discussed above, certain problems exist in this approach. One of the problems of the spaced donor arrangement is the difficulty of maintaining the aforementioned spaced relationship between the donor surface and the photoconductive surface. Additionally, in all transfer development systems, uniform deposition of toner onto the donor, which is a requirement for high quality prints, has been difficult to achieve because of the tendency of toner to clump and because of the internal electrostatic forces among the toner particles.

One approach for obviating the above problems has been the use of a donor member having a surface with raised and depressed portions, such as a gravure surface with an elevated grid network enclosing a plurality of depressed cups, as disclosed in Greig, U.S. Pat. No. 2,811,465. If such a donor member were used in contact with the imaging surface and doctored such that toner resided only in the cups, theoretically the toner would not contact the background, or uncharged, areas of the imaging surface. That is, the uniform gap between toner and image could be maintained by having the raised areas of the donor as the only point of contact on the imaging surface. Toner would, of course, still be attracted from the depressed portions of the donor to the charged areas, but the need for complicated, gap-controlling means would be eliminated. Additionally, the roughened surface would tend to break up clumps of toner during the loading step.

However, in practice, although such a donor member produced somewhat improved transfer development, it was found that toner could not be efficiently loaded on the donor without at least partially covering the raised grid structure with toner. Thus, toner was still contacting background areas of the imaging surface, thereby producing some background deposition in the copy. Also, the images produced bore the impression of the grid structure due to interference of the grid with complete toner deposition on the charged areas. Clearly, both the above results are undesirable in a high-quality imaging process.

SUMMARY OF THE INVENTION

It is accordingly an object of the present invention to provide an electrostatographic copying method and apparatus employing touchdown development with improved means for achieving self-spacing between the donor surface and the imaging surfaced.

It is a further object of the present invention to provide an improved method and apparatus for laying down a uniform layer of toner on a donor surface.

It is a further object to produce a donor having improved durability and strength characteristics notwithstanding the physical pressures of toner loading and image development.

The above objects and other advantages are realized by providing, for example, in a xerographic transfer development apparatus, a developer donor member having disposed on its surface a plurality of raised, discrete micro-elements, having the geometry hereafter described, in an amount sufficient to maintain a uniform gap between the floor of the donor surface and the imaging surface when they are in contact. One preferred method for producing such donor surfaces is photo-etching of light sensitive materials on a substrate to either directly produce the elements or form a mold against which the donor surface may be cast, to be described below.

The micro-elements are elongated, with essentially straight-line sides, and are "boat"-shaped at at least one end, i.e., in horizontal cross-section, at least one end is tapered to a point. The advantage of this particular configuration will be further explained below.

The micro-element spacing means generally serve three important functions:

1. They serve a metering function to control toner layer thickness during the doctoring process;
2. In the doctoring process they break up loose clumps of toner of the type present in any mass of small particles; and
3. They prevent compression of, and reduce contact of, the toner against the photoreceptor to the extent that background deposits are virtually eliminated, and images of very fine quality can be produced.

DESCRIPTION OF THE DRAWINGS

FIG. 1 schematically illustrates a spaced transfer, or touchdown development, xerographic imaging system, where the spacing is maintained by the raised elements on the donor surface.

FIG. 2 illustrates, in a side sectional view, a toner-bearing donor in accordance with this invention.

FIG. 3 is a top, enlarged representation of a section donor surface, illustrating a preferred shape and distribution micro-elements on a donor surface of this invention.

FIG. 4 illustrates a doctor blade technique for distributing a uniform layer of toner between the spacing elements on the donor surface.

FIG. 5 illustrates a donor of this invention in self-spaced relationship with an imaging surface during image development.

DETAILED DESCRIPTION OF THE INVENTION

Figure 6:
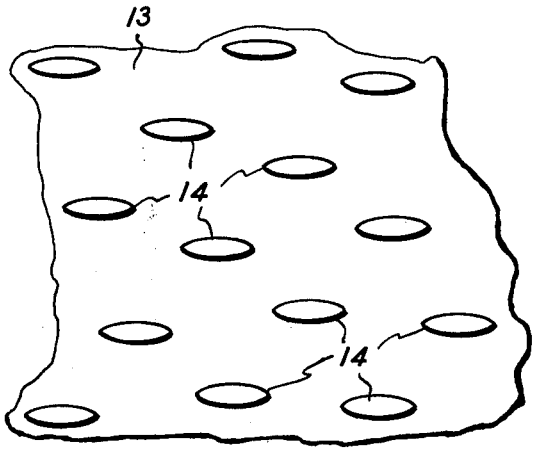
FIG. 6 is a top view illustrating a preferred shape and distribution of microelements on a donor surface of this invention.

Referring initially to FIG. 1, shown there is a xerographic reproduction system compatible with the present invention, even though this invention is useful in any electrostatographic imaging system. The system comprises a xerographic photoconductive plate in the form of drum 1. The drum is driven by conventional means which rotates the surface counterclockwise through stations A – E as indicated in the figure. The drum has a suitable photosensitive surface, which may, for example, include selenium overlying a layer of conductive material, upon which a latent electrostatic image can be formed. The various stations about the periphery of the drum are the charging station A, exposing station B, developing station C, transfer station D, and cleaning station E. At the charging station A, a suitable charging means 2, such as a corotron, places a uniform electrostatic charge on the photoconductive surface. As the drum rotates, the charged area is brought to station B where a suitable exposing device 3 supplies the light image to be reproduced. A latent electrostatic image is thus formed on the surface of the drum. This image is then developed at station C by the application of a finely divided, pigmented, electroscopic powder called toner. The developed image then passes through transfer station D which includes the copy sheet 5, corona charging device 6, and fusing element 7. The last station E performs the function of cleaning the surface such as the use of brush 4 or any other suitable conventional device.

Referring particularly to the developing station C of FIG. 1, a donor member 8 is shown which is preferably clockwise rotatable by conventional means (not shown).

Adjacent donor member 8 is a toner reservoir 9 containing toner particles 10. The donor member or roll 8 is positioned so that a portion of its periphery comes into contact with toner 10. Also located around the donor roll 8 are charging means 11 and 12. Charging means 11, which may be a corona charging device, is adapted to place a uniform charge on the toner particles of a polarity opposite to the polarity of the latent image on the photoconductive drum. Charging means 12, also a corona charging device, is for neutralizing the charge on the toner to aid in the removal of residual toner by an appropriate cleaning means (not shown).

In this arrangement, the surface of donor member 8 has disposed thereon a plurality of raised, discrete micro-elements so as to provide a small gap "*g*" as shown in FIG. 1 which can be up to several mils. This gap may be filled or partially filled with electroscopic toner particles. In accordance with the present invention, this gap is maintained in a self-spacing manner as described below.

In FIG. 2, the cross-section of a donor member is shown. In the figure, an electrically conductive layer or member 13, is affixed to a flexible backing element 15. The conductive layer 13 may be aluminum, for example. The self-spacing elements 14 are either permanently adhered to, or integral with, the substrate. The substrate 13 should be a conductive material, for reasons to be explained below.

The micro-elements disposed on the donor surface have essentially straight-line walls, as opposed to a curved or rounded shape. The sides can be essentially vertical from the base, or floor, of the donor surface to the top of the element, or tapered inward. The microelements are elongated, i.e., have a length to width ratio greater than one. Preferably, on at least one end of each element, the side walls taper horizontally, with respect to the donor surface, so as to meet in a vertical-line intersection, forming a vertical wedge (a "V" structure seen in horizontal top cross-section). Most preferably, the micro-elements are boat-shaped; i.e., the length is much greater than the width, the side walls tapering together at the front and back of the element as shown in FIG. 3. This invention also contemplates a squarebacked, boat-shaped element, as in, if the inventor may be forgiven, a row-boat shape. Also within the purview of this teaching are micro-elements having elongated diamond shapes. However, preferred are the boat shapes having two-walled, tapering sides, or three-walled, square-backed shapes.

The height of the micro-elements of this invention is preferably from about 20 microns to about 100 microns, and most preferably from about 40 to about 70 microns. It is preferred that the height be equal to, or less than, the length of the element.

Generally, the length of the preferred micro-element will range from about 50 to 150 microns. Typically, the width will be from about 15 to about 40 microns, consistent with the above-mentioned requirement that the width be less than the length.

It is preferred that the micro-elements be arranged on the donor surface with their lengthwise axes essentially parallel and at least one length-wise tapered end of each facing substantially the same direction as at least one tapered end of the others, as is represented by the orientation of the micro-element array in FIG. 3. This type of configuration makes optimum use of the particular geometry of the micro-elements of this invention.

The micro-elements should be relatively uniformly spaced apart from each other, and be present in a density sufficient to maintain a relatively uniform gap between the donor surface and the imaging surface, and to insure that any vestige of this pattern appearing in a developed image is such that the individual dots cannot be resolved by the unaided eye. The ratio of the total surface area of the micro-element top to the total surface area of the donor should be small, preferably less than about 15%, and most preferably less than about 10%, so as not to prevent substantially complete development of the charged areas of the imaging surface. Thus, a preferred density is, for example, from about 5 to 100 elements per square millimeter.

Although relatively uniform element-to-element spacing is preferred as mentioned before, it has been found that undesirable moire image effects may be produced if the geometrical array of elements is a perfectly repeated pattern. Thus, it is preferred that, within the element density range above, the array of elements across the donor surface be somewhat random, as in FIG. 3, such that moire effects are substantially eliminated.

Referring to FIG. 3, shown is a greatly enlarged representation of a preferred donor surface of this invention, illustrating an array of boat-shaped elements 14 across the floor of the donor surface 13. Depending on which of the below-described processes for making the donor are used, the elements 14 are either permanently adhered to surface 13 by physical chemical forces, or are integral with, and projections of, the surface material.

FIG. 4 shows a section of the donor member in which a doctor blade 17 which may be of a rigid or semi-rigid material such as steel, plastic or a vulcanized elastomer is used to distribute toner from a toner supply 18 between spacer elements 14 to form toner layer 19 on donor element surface 16. The doctor blade may be edged in any suitable fashion at the points of contact with the spacing elements. If the blade tip is pointed, the array of the elements 14 should be geometrically random or closely spaced enough across the donor surface that the blade will not dip between elements and thus form concavities in the toner layer. The blade tip may also be bevelled parallel to the donor surface, in which event the bevel width of the blade will span the elements sufficiently to prevent dipping into the toner. Alternatively, the blade may be made flexible enough to bend during doctoring and wipe across elements with the side of the blade instead of the edge.

Referring to FIG. 5, cylindrical donor 8 is shown in development contact with a xerographic drum 1 bearing an electrostatic latent image on its surface. The donor 8 rides on drum 1 by means of the contact of spacing elements 14 on the drum surface, as at contact point 21. It will be seen that, in this manner, the donor surface itself is kept from contact with the drum surface so that the toner layer 19 can be retained between spacing elements 14 in a non-compacted state. Also, if the toner layer thickness is kept at or below the average height of the elements 14 above the donor surface, little or no toner will contact the drum 1 in uncharged or background regions, thus substantially preventing toner deposits in non-image areas of the drum. Preferably, a suppressing bias is applied to the donor surface, of the same polarity as that of the latent image, and of course opposite that of the toner. This bias should be considerably smaller than the magnitude of the latent image potential. Thus, toner will tend not to be attracted to background areas, and will still be attracted by the much greater charge in image areas to develop them adequately.

As the donor 8 encounters the electrostatically-imaged areas on drum 1, toner is selectively attracted to the drum and deposits thereon as the developed image 20.

Referring again to the toner loading step as seen sideways in FIG. 4, the boat-shape geometry is most advantageously used when the direction of doctoring is essentially counter to the direction in which the tapered ends of the elements are facing, preferably 180° counter. In this event, the elements are strong in the direction in which strength is necessary, i.e., the direction in which the blade is moving, and have a tapered loading edge to reduce or eliminate toner impaction or buildup against the base of the elements, as might occur if, e.g., the elements were of rounded, cylindrical, or squared shape.

The preferred methods for preparing the donor surfaces useful in this invention involve the use of photomechanical materials, such as photopolymers and photoresists. Basically, donor surfaces can be prepared from any of a number of well-known techniques including the following procedures:

a. Exposing a photo-hardenable or photo-softenable material through a transparency having the desired pattern, and washing away the soft portions of the layer to leave the hard micro-elements permanently adhered to the substrate;

b. Using the same techniques to create the inverse structure, a mold with depressions at the micro-element sites, and using this mold to case a suitable donor material to form the donor surface;

c. Using the donor surface created in step (a) as a master, casting a suitable mold material over this to form an inverse mold, and then using this mold to cast the final donor surface.

All of these procedures involve exposure of the photosensitive material through an original transparency containing clear areas corresponding in shape to the micro-elements desired on the donor surface. Any suitable method for producing the transparency, of the many known in the art, may be used herein.

EXAMPLE I

One method for producing the donors of this invention according to the general method (c) above, is as follows:

two line grid transparencies are superposed at an angle to each other to produce to moire pattern; the density, shape, and dimensions of the resulting boat-shaped openings depend upon the line-frequency, line-width, and superposition angle of the two transparencies; a contact photographic print of the pattern is then made, using, for example, a contact reversal film, to produce the master transparency;

or alternatively, a large scale drawing of a small section of the desired donor surface is made by hand or computer, this drawing photographed and reduced in size, and the master transparency produced by a step-and-repeat photographic process;

then, a photohardenable resist material is exposed through the master transparency; the areas exposed to light (boat-shaped openings) are hardened thereby; generally, the resist material is laminated to a suitable substrate throughout the procedure herein; the thickness of the resist is determined by the height of the micro-elements desired, and by the minimum materials considerations of the resist material itself; the unexposed, soft background of the resist is removed, usually by solvent wash-away techniques, leaving the hardened, boat-shaped micro-elements adhered to the substrate;

a mold is then made from the resulting resist master, from a flexible, easily-releasing material, such as silicone rubber, by casting a liquid silicone rubber compound against the master; a sturdy backing plate is pressed against the rubber, and the entire composite is cured while on the resist master;

the silicone rubber mold thus produced has depressions corresponding to the donor micro-elements desired; a donor surface is then prepared by casting the donor material against the mold under conditions selected to force the donor material to flow into, and along, the mold surface; a preferred material in a polyurethane coated on a suitable substrate, which is pressed against the mold under heat and pressure such that the softened polyurethane flows into the mold depression and along the mold surface; after curing, the polyurethane is removed, yielding a donor comprising the substrate coated with the polyurethane layer having a floor, or base, and bearing the boat-shaped micro-elements desired; this donor surface is then suitably mounted on a donor frame and used in the imaging method described herein.

EXAMPLE II

Donors having boat-shaped micro-elements with both ends tapered, as in FIG. 3, about 25 microns wide and 140 microns long, were prepared according to general Example 1 as follows:

the master transparency was prepared by superposing a line-grid transparency of 133 lines per inch over another having 175 lines per inch, at an angle of 15° with respect to each other; a print was made of the pattern using DuPont Cronar Contact Reversal (CRW-4) film to produce the master;

DuPont Riston Type 305 photopolymer resist film, a photo-hardenable material, was laminated in thicknesses of 25, 50, 75, and 100 microns to several 6-mil thick sheets of grained aluminum, 11 inches by 18.5 inches using a DuPont A24 Laminator; the photoresists were then exposed through the master transparency to a 100 amp high intensity printing lamp for 2 minutes at a distance of 3 feet; the resists were then developed by spraying with stabilized 1,1,1-trichloroethane for about 2 minutes, leaving the micro-elements of height corresponding to the thickness of the original resist film; the element distribution was about 10 elements per square millimeter; molds of the Riston masters were made by casting a commercially-available liquid silicone rubber against them and placing a 0.075 inch thick steel backing plate upon the rubber while it was cured; the silicone rubber layers cured to a 1/16 inch thickness; the Riston masters were then removed easily from the rubber mold;

the actual donors were prepared from a commercially-available polyurethane material, Estane 5707F1, from B. F. Goodrich Chemical Co.; a coating solution was prepared consisting of 20 percent by weight Estane, in a solvent mixture comprised of four parts tetrahydrofuran and one part dimethylformamide; the solution is poured evenly across six mil thick grained aluminum sheets, 10 by 18 inches in size, by means of a ⅝ inch diameter steel rod drawn across the sheets at a speed of about one foot per second; the resulting coatings, when dried and cured, are 0.8 mils thick;

the polyurethane plates were placed against the silicone molds, each positioned on a large plate having a vacuum pumping port, and covered with 1.4 mil aluminum foil such that the entire composite is sealed; the composites are placed in an oven and subjected to a vacuum pressure differential of 1 atmosphere while the oven is heated to 180° C over a period of 40 minutes and held there for another 15 minutes; the temperature is allowed to fall to room temperature, at which point the vacuum is released; the donor is then peeled from the mold.

EXAMPLE III

Donors made according to the method of example II were used to develop electrostatic images in a flat plate mode using a flat plate donor and xerographic plate with a selenium alloy photoreceptor; xerographic images of approximately plus 800 volts were generated on the photoreceptor, and developed by contact with the donor, self-spaced from the photoreceptor surface by means of micro-elements 14; toner was doctored onto the donor from a toner supply by means of a bevelled steel doctor blade, such that the motion of doctoring was directed lengthwise across the elements; standard Xerox 2400 toner was used in this test; throughout the development step, a small suppressing positive electric bias of plus 200 volts was applied to the donor surface; after loading, the donor was corona-charged to about minus 100 volts; acceptable quality images were obtained with donors at all element height levels, with maximum quality being obtained where the height was between 50 and 75 microns; after the image tests had been run, it was observed that little or no toner had become impacted around the bases of the boat-shaped micro-elements, that toner loaded very evenly and uniformly across the donor surface with little or no clumping, and that the spacer elements were not broken or deformed during the loading process. This points out a major advantage of the element geometry when used in the imaging system of this invention, namely, a strength advantage. Since the doctor blade is drawn across the lengthwise axes of the spacing elements, the pressure of doctoring is distributed lengthwise, which is the direction of greatest support for each individual element. Thus, the tendency for a spacing element to break under stress is reduced or eliminated.

While a specific preferred procedure for producing the donor members of this invention has been described in the above examples, any acceptable method for adhering the micro-elements that have been described permanently to a suitable substrate can be used within the scope of this invention.

Preferably, the donor surface is provided with a small suppressing bias, although this is not absolutely necessary. The bias tends to hold toner on the surface, and reduces the tendency of the donor to form background images in the uncharged, non-imaged areas of the photoreceptor. Preferably, the bias ranges from about 50 to 150 volts with polarity the same as that of the charged areas of the photoreceptor. It is preferred that the donor by charged immediately after being doctored onto the donor surface and prior to development. This charge should be opposite that of the charge on the photoreceptor and preferably ranges from about 50 to 150 volts, depending on toner thickness. Preferably, as mentioned before, the direction of doctoring is substantially along the length of the micro-elements, beginning from a tapered length of the micro-elements, although some deviation from the direction is permissible.

The functioning of the process and apparatus of this invention is basically independent of the types of photoreceptor, toner material, and method of latent electrostatic imaging known to those skilled in the art of electrophotographic copying processes. It will be obvious that many variations from the the disclosure herein may be practiced without departing from the scope of this invention.

I claim:

1. An electroscopic-developer donor member comprising a surface, and having adhered on its surface a plurality of raised, discrete microelements having vertically essentially straight sides, the ratio of length to width of said microelements being greater than one, at least one end of each element being tapered to resemble a wedge as seen in horizontal cross-section, the elements being so oriented on said donor surface that each element has a tapered end pointing in substantially the same direction as a tapered end of every other element.

2. The donor member of claim 1 where the microelements are tapered at both ends of their lengthwise axes.

3. The donor member claim 1 where the micro-elements are distributed on the donor surface in an amount of from about 5 to 100 elements per square millimeter, where the height of the microelements is from about 20 to 100 microns, the length is from about 50 to 150 microns, and the width is from about 15 to 40 microns.

4. An electrostatographic imaging apparatus comprising, an imaging member with a surface capable of retaining an electrostatic latent image, a donor member with a surface capable of supporting a layer of particulate image-developing material, and means for bringing the toner-bearing surface of the donor member into contact with the surface of said imaging member; where the donor member has adhered on its surface a plurality of raised, discrete microelements for self-spacing the donor member from the imaging member, said elements having vertically essentially straight sides, the ratio of length to width of said microelements being greater than one, at least one end of each element being tapered to resemble a wedge as seen in horizontal cross-section, the elements being so oriented on said donor surface that each element has a tapered end pointing in substantially the same direction as a tapered end of every other element.

5. The apparatus of claim 4 further comprising means for distributing the particulate image-developing material on the donor member surface, said means comprising a doctor edge and means for bringing the doctor edge into relative movement with the donor member while contacting the tops of said microelements, in a direction substantially parallel to the lengthwise axes of said microelements.

6. The apparatus of claim 4 where the micro-elements are tapered at both ends of their lengthwise axes.

7. The apparatus of claim 4 where the micro-elements are distributed on the donor surface in an amount of from about 5 to 100 elements per square millimeter, where the height of the microelements is from about 20 to 100 microns, the length is from about 50 to 150 microns, and the width is from about 15 to 40 microns.

* * * * *